US006942441B1

(12) United States Patent
Lathrop

(10) Patent No.: US 6,942,441 B1
(45) Date of Patent: Sep. 13, 2005

(54) METHOD AND APPARATUS FOR INSERTING A SPIRAL BINDER

(76) Inventor: Peter N. Lathrop, 26659 N. Main St., Wauconda, IL (US) 60084

( * ) Notice: Subject to any disclaimer, the term of this patent is extended or adjusted under 35 U.S.C. 154(b) by 351 days.

(21) Appl. No.: 10/247,963

(22) Filed: Sep. 20, 2002

(51) Int. Cl.[7] ..... B42B 9/00

(52) U.S. Cl. ..... 412/38; 412/6; 412/7; 412/33; 412/39; 412/40; 425/391; 140/92.3; 140/92.9; 140/92.93; 140/92.7

(58) Field of Search ..... 412/6, 7, 33, 38–40; 425/391; 140/92.3, 92.9, 92.93, 92.7

(56) References Cited

U.S. PATENT DOCUMENTS

| | | | | |
|---|---|---|---|---|
| 2,182,844 | A * | 12/1939 | Grumbacher | 140/92.94 |
| 2,808,079 | A * | 10/1957 | Tauber | 140/92.3 |
| 2,961,012 | A | 11/1960 | Freundlich | |
| 3,134,406 | A | 5/1964 | Freundlich et al. | |
| 3,866,254 | A | 2/1975 | Gronda | |
| 4,249,278 | A | 2/1981 | Pfaffle | |
| 4,267,865 | A * | 5/1981 | Negro | 140/92.94 |
| 4,378,822 | A | 4/1983 | Morris | |
| 4,537,545 | A * | 8/1985 | Kunzmann | 412/7 |
| 5,454,679 | A * | 10/1995 | Whiteman, Jr. | 412/39 |
| 5,527,141 | A * | 6/1996 | Malmstrom | 412/38 |
| 5,584,632 | A | 12/1996 | Stiles et al. | |
| 5,695,308 | A | 12/1997 | Hastings et al. | |
| 5,785,479 | A * | 7/1998 | Battisti et al. | 412/39 |
| 5,890,862 | A * | 4/1999 | Spiel et al. | 412/40 |
| 5,931,623 | A | 8/1999 | Hastings et al. | |
| 5,934,340 | A | 8/1999 | Anthony, III et al. | |
| 5,941,289 | A * | 8/1999 | Fuchs | 140/92.3 |
| 6,000,896 | A | 12/1999 | Spiel et al. | |
| 6,033,171 | A | 3/2000 | Doyle et al. | |
| 6,036,423 | A * | 3/2000 | Westra et al. | 412/38 |
| 6,042,320 | A | 3/2000 | McHenry, Jr. et al. | |
| 6,056,495 | A | 5/2000 | Doyle et al. | |
| 6,312,204 | B1 | 11/2001 | Spiel et al. | |
| 6,382,950 | B1 * | 5/2002 | DesJarlais et al. | |
| 6,547,502 | B1 * | 4/2003 | Spiel | 412/40 |
| 6,726,426 | B2 * | 4/2004 | Spiel | 412/40 |
| 6,739,626 | B2 * | 5/2004 | Mori et al. | 281/28 |

FOREIGN PATENT DOCUMENTS

| | | | |
|---|---|---|---|
| GB | 1411987 | * | 10/1975 |
| GB | 2044676 | A | 3/1980 |

* cited by examiner

*Primary Examiner*—Derris H. Banks
*Assistant Examiner*—Mark Henderson
(74) *Attorney, Agent, or Firm*—Mathew R. P. Perrone, Jr.

(57) ABSTRACT

Sheets of paper are commonly held together with a spiral coil, which coil is inserted by a machine with at least one rotating spindle thereon. The spindle receives a spiral binder in a male to female relationship. As the spindle rotates the spiral binder, the spiral binder feeds into a stack of sheets having the appropriate apertures to receive the spindle and bind the pages together.

11 Claims, 2 Drawing Sheets

METHOD AND APPARATUS FOR INSERTING A SPIRAL BINDER

This invention relates to a method and apparatus for inserting a spiral binder; and more particularly to a method and apparatus for inserting a spiral binder using an inside grip.

BACKGROUND OF THE INVENTION

Sheets of paper are commonly held together with a spiral binder. Each sheet of paper has a series of apertures spaced a short distance away from the edge thereof. Each series of apertures on each sheet is alignable with the series of apertures on an adjoining sheet. As the sheets are stacked, it is possible to insert coil therethrough, thereby providing that the sheets will be held together.

Both books and notebooks may be formed in this fashion. The notebooks contain paper, which may be either blank or lined in some fashion. Typical of the lining on such pages lines to guide writing or graph paper. Such notebooks may be used in business or education systems for a person to record information with a writing instrument. If the paper in the spiral paper assembly has some printed words thereon, it becomes a book of some sort or as desired.

Inserting the coil through the aligned apertures can be a problem. Such insertion can be accomplished by hand or machine. A hand insertion of the coil is time-consuming and difficult. An appropriate machine to insert the coil is difficult to obtain, in an efficient, inexpensive fashion.

While many machines exist to assist with this insertion, most are grossly ineffective. Firstly, a typical machine can be complicated and expensive. Such a machine is not suitable for a relatively small print shop. Not only does such a machine take up too much space, the expense makes it extremely unlikely that such a shop can even afford this type of machine.

Also, the machines of the prior art are directed to outside pressure on the coil being inserted. Such pressure tends to deform the coil and interfere with a smooth insertion of the coil and into the desired number of sheets of paper. Such a deforming pressure does not resolve the problem and improve spiral coil insertion.

It thus becomes clear that it is very desirable to have a simplified machine, which may be inexpensively developed and effective. Such a machine can greatly increase the efficiency for the spiral binding of sheets of paper.

SUMMARY OF THE INVENTION

Among the many objectives of this invention is the provision of a coil insertion machine for inserting a coil into a series of sheets of paper in order to form a spiral bound book of paper.

A further objective of this invention is the provision of a coil insertion machine adapted to receive a plurality of different sized coils.

A still further objective of this invention is the provision of a coil insertion machine with minimal exterior pressure on the coil.

Yet a further objective of this invention is the provision of a coil insertion machine to simplify placement of a coil into a spiral bound book.

These and other objectives of the invention (which other objectives become clear by consideration of the specification, claims and drawings as a whole) are met by providing a machine with at least one rotating spindle thereon. The spindle receives a spiral binder in a male to female relationship. As the spindle rotates the spiral binder, the spiral binder feeds into a stack of sheets having the appropriate apertures to receive the spindle and bind the pages together.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

For a coil insertion machine, a spindle has a coil for a spiral bound book placed thereon. Then a stack of paper having appropriate apertures along the side thereof is permitted to receive the coil into the apertures, as the spindle rotates with the coil thereon. The use of the coil insertion machine, with the coil mounted on a spindle, or another, similar rotating member in a female to male relationship, permits the coil to be inserted efficiently and sequentially into the series of apertures. Such an insertion occurs without applying pressure on the outside of the coil or distorting the same.

Such a coil insertion machine can be inexpensively produced, thereby permitting even an independent printing shop to have machine, which greatly reduces the time to form spiral books. One person using the coil insertion machine of this invention can easily do the work of at least ten people inserting coils by hand.

In a preferred form, the coil insertion machine is especially useful for binding a printed book. Also preferred is a plastic spiral coil. However, the coil insertion machine of this invention is also usable with metal coils.

The housing of the coil insertion machine is most conveniently a hollow box with a rectangular cross section. Within the box is mounted, in a standard, an electric motor having a least one shaft thereon. On the shaft is mounted, in a standard fashion, a rotating member adapted to receive a coil. The desirable rotating member releasably receives a coil thereon. If two rotating members are present, they may be on the same or different sides of the box. Preferably the spindles are on different sides of the box.

Figure 1:
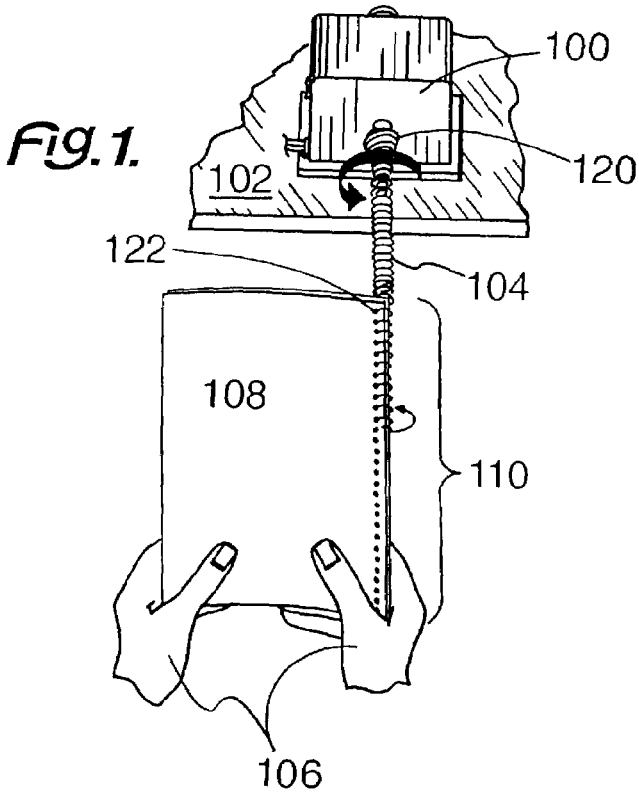
FIG. 1 depicts a perspective view of the coil insertion machine 100 of this invention in use.

Referring now to FIG. 1, coil insertion machine 100 has a smaller threaded spindle 120 mounted thereon. While the coil insertion machine 100 is mounted or placed on table 102 or other appropriate surface, a spiral coil 104 is placed in a female to male relationship with the smaller threaded spindle 120. Hands 106 hold stacked sheets of paper 108 with a series of apertures 110 along one side thereof. Spiral coil 104 is started in at least the first aperture 122 at one end of the series of apertures 110.

At that point power in coil insertion machine 100 is activated, causing smaller threaded spindle 120 to rotate and drive spiral coil 104 sequentially into the series of apertures 110, thereby binding sheets of paper 108 together. In this fashion, a booklet, or at least a partially secured group of pages, may be formed.

Figure 2:
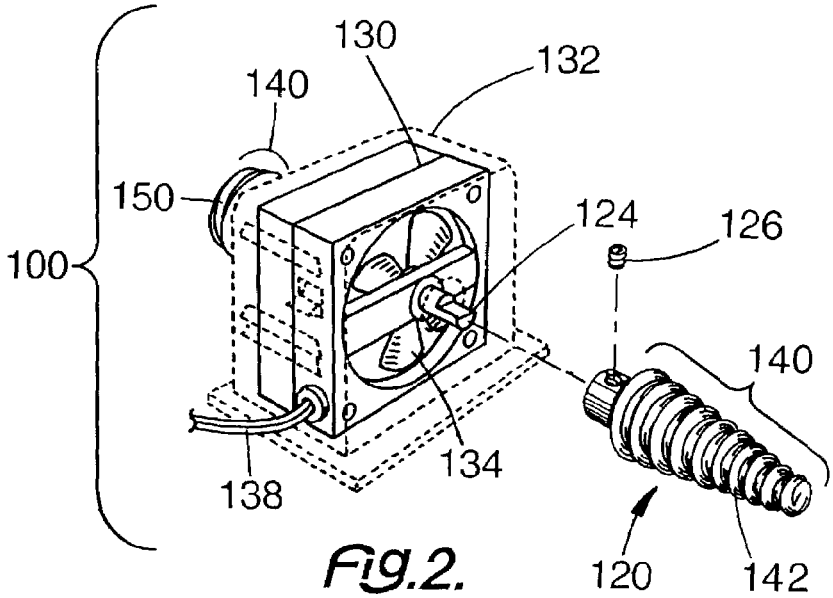
FIG. 2 depicts a perspective, partially-exploded view of the coil insertion machine 100.

Adding FIG. 2 to the consideration, coil insertion machine 100 has smaller threaded spindle 120 mounted on drive shaft 124 and secured thereto with set screw 126. Drive shaft 124 is rotated by an electric motor 130 mounted in a housing 132 in a standard fashion. Operably connected in the housing 132 is also a cooling fan 134, which renders the coil insertion machine 100 more efficient. Electric motor 130 may receive power from a standard power cord 138, or other suitable fashion.

Figure 3:
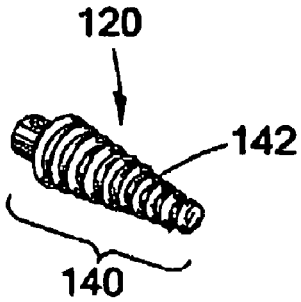
FIG. 3 depicts a perspective view of a smaller threaded spindle 120 for the coil insertion machine 100 of this invention.
Figure 4:
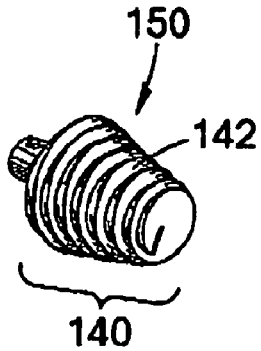
FIG. 4 depicts a perspective view of a larger threaded spindle 150 for the coil insertion machine 100 of this invention.

Adding FIG. 3 and FIG. 4 to the consideration, in a preferred form, threaded spindle 120 has a generally truncated conical shape 140 with gripping threads 142 thereon. For larger versions of coil 104, larger threaded spindle 150 is used and may even be placed on the opposite side of electric motor 130 as shown in FIG. 2. On the opposite side of electric motor 130 is a second shaft structure similar to drive shaft 124 with larger threaded spindle 150 secured thereto in a similar fashion with a set screw like set screw 126.

Figure 5:
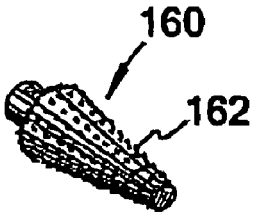
FIG. 5 depicts a perspective view of a smaller punched spindle 160 for the coil insertion machine 100 of this invention.
Figure 6:
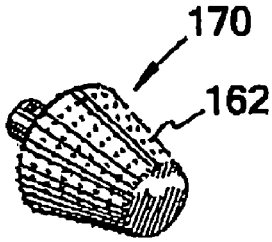
FIG. 6 depicts a perspective view of a larger punched spindle 170 for the coil insertion machine 100 of this invention.

FIG. 5 and FIG. 6 are similar to FIG. 3 and FIG. 4, but for the replacement of threads 142 with a punched surface 162, used to grip coil 104. Because threads 142 appear more durable and reliable in the grip of coil 104, threads 142 are preferred to punched surface 162.

Figure 7:
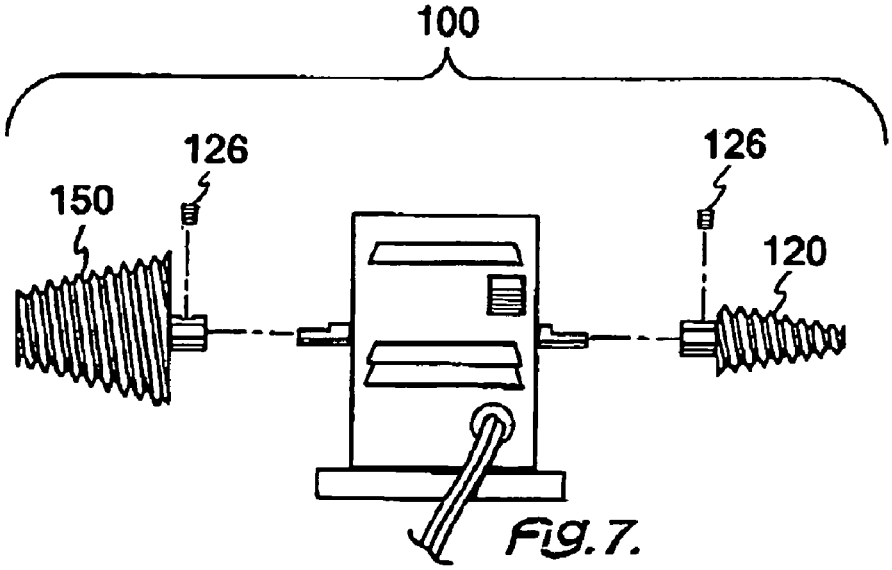
FIG. 7 depicts a side, exploded view of coil insertion machine 100.

FIG. 7 adds a further dimension to coil insertion machine 100. Larger threaded spindle 150 and smaller threaded spindle 120 can be mounted on either side thereof with set screw 126. The positions of smaller threaded spindle 120 and larger threaded spindle 150 may also be reversed.

This application; taken as a whole with the specification, claims, abstract, and drawings; provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters of the United States is:

1. An apparatus for inserting a spiral binder into a plurality of aligned sheets having a plurality of alignable apertures along an edge of each member of the plurality of aligned sheets, comprising:

(a) the apparatus having a housing, at least one rotating member mounted on the housing and a power source for the rotating member in the housing;

(b) the rotating member being adapted to receive a spiral coil;

(c) the rotating member being adapted to cause a rotation of the spiral coil;

(d) the rotation causing the spiral coil to feed into the plurality of apertures and to bind the plurality of sheets into a book;

(e) the at least one rotating member receiving the spiral coil in a male to female relationship in order to avoid external pressure on the coil;

(f) the spiral coil being adapted to a spacing of the plurality of apertures;

(g) the at least one rotating member having a surface selected from the group consisting of a smaller threaded spindle and a larger threaded spindle;

(h) the smaller threaded spindle being adapted to receive the spiral coil having a smaller diameter; and (i) the larger threaded spindle being adapted to receive the spiral coil having a larger diameter;

(j) the smaller threaded spindle and the larger threaded spindle being mounted on opposing sides of the housing;

(k) the smaller threaded spindle and the larger threaded spindle being attached to an electric motor; and (l) the electric motor having a cooling fan.

2. The apparatus of claim 1 further comprising:

(a) the at least one rotating member having a surface selected from the group consisting of a smaller punched spindle surface and a larger punched spindle surface;

(b) the smaller punched spindle surface being adapted to receive the spiral coil having a smaller diameter; and (c) the larger punched spindle surface being adapted to receive the spiral coil having a larger diameter.

3. A method for inserting a spiral binder into a plurality of aligned sheets having a plurality of alignable apertures along an edge of each member of the plurality of aligned sheets, comprising:

(a) providing housing with at least one rotating member mounted on the housing and a power source for the rotating member in the housing;

(b) placing a spiral coil on the rotating member;

(c) aligning an end of the spiral coil with a first end aperture in the plurality of alignable apertures;

(d) causing a power rotation of the spiral coil sequentially into the plurality of alignable apertures to form a bound book; and (e) recovering the bound book;

(f) the at least one rotating member receiving the spiral coil in a male to female relationship in order to avoid external pressure on the coil;

(g) the spiral coil being adapted to a spacing of the plurality of apertures;

(h) the at least one rotating member being selected from the group consisting of a smaller threaded spindle and a larger threaded spindle;

(i) the smaller threaded spindle being adapted to receive the spiral coil having a smaller diameter;

(j) the larger threaded spindle being adapted to receive the spiral coil having a larger diameter;

(k) mounting the smaller threaded spindle and the larger threaded spindle on opposing sides of the housing;

(l) attaching the smaller threaded spindle and the larger threaded spindle to an electric motor; and (m) cooling the electric motor with a fan.

4. The method of claim 3 further comprising:

(a) the at least one rotating member having a surface selected from the group consisting of a smaller punched spindle surface and a larger punched spindle surface;

(b) the smaller punched spindle surface being adapted to receive the spiral coil having a smaller diameter; and (c) the larger punched spindle surface being adapted to receive the spiral coil having a larger diameter.

5. The method of claim 4 further comprising:

(a) mounting the smaller threaded spindle and the larger threaded spindle on opposing sides of the housing;

(b) attaching the smaller threaded spindle and the larger threaded spindle to an electric motor; and (c) cooling the electric motor with a fan.

6. The method of claim 5 further comprising:

providing the smaller threaded spindle, the larger threaded spindle, the smaller punched spindle and the larger punched spindle having a truncated conical shape.

7. An apparatus for inserting a spiral binder into a plurality of aligned sheets having a plurality of alignable apertures along an edge of each member of the plurality of aligned sheets, comprising:

(a) the apparatus having a housing, at least one rotating member mounted on the housing and a power source for the rotating member in the housing;

(b) the rotating member being adapted to receive a spiral coil;

(c) the rotating member being adapted to cause a rotation of the spiral coil;

(d) the rotating member having a truncated concial shape;

(e) the rotation causing the spiral coil to feed into the plurality of apertures and to bind the plurality of sheets into a book;

(f) the at least one rotating member receiving the spiral coil in a male to female relationship in order to avoid external pressure on the coil; and (g) the spiral coil being adapted to a spacing of the plurality of apertures.

8. The apparatus of claim 7 further comprising:

(a) the at least one rotating member having a surface selected form the group consisting of a smaller threaded spindle and a larger threaded spindle;

(b) the smaller threaded spindle being adapted to receive the spiral coil having a smaller diameter; and (c) the larger threaded spindle being adapted to receive the spiral coil having a larger diameter.

9. The apparatus of claim 7 further comprising:

(a) the at least one rotating member having a surface selected from the group consisting of a smaller punched spindle surface and a larger punched spindle surface;

(b) the smaller punched spindle surface being adapted to receive the spiral coil having a smaller diameter; and (c) the larger punched spindle surface being adapted to receive the spiral coil having a larger diameter.

10. The apparatus of claim 8 further comprising:

(a) the smaller threaded spindle and the larger threaded spindle being mounted on opposing sides of the housing;

(b) the smaller threaded spindle and the larger threaded spindle being attached to an electric motor; and (c) the electric motor having a cooling fan.

11. The apparatus of claim 9 further comprising:

(a) the smaller punched spindle surface and the larger punched spindle surface being mounted on opposing sides of the housing;

(b) the smaller punched spindle surface and the larger punched spindle surface being attached to an electric motor; and (c) the electric motor having a cooling fan.

* * * * *